United States Patent [19]

Mulvaney

[11] Patent Number: 4,795,141

[45] Date of Patent: Jan. 3, 1989

[54] CAM LOCKED STUD NAILING FIXTURE

[75] Inventor: Thomas W. Mulvaney, Kansas City, Mo.

[73] Assignee: Spectrum Innovations, Inc., Kansas City, Mo.

[21] Appl. No.: 101,741

[22] Filed: Sep. 28, 1987

[51] Int. Cl.[4] ..... B25B 5/14

[52] U.S. Cl. ..... 269/41; 269/236; 269/904; 269/315

[58] Field of Search ..... 269/41, 42, 152–155, 269/236, 904, 315

[56] References Cited

U.S. PATENT DOCUMENTS

| | | | |
|---|---|---|---|
| 1,297,539 | 3/1919 | Bull | 269/236 |
| 1,769,511 | 7/1930 | Heston et al. | 269/41 |
| 2,455,268 | 11/1948 | Perry | 269/236 |
| 2,575,595 | 11/1951 | Rienecker | 269/41 |
| 2,680,459 | 6/1954 | Dodsen et al. | 269/41 |
| 2,911,022 | 11/1959 | Brown | 269/41 |
| 2,969,819 | 1/1961 | Bravo | 269/904 |
| 3,083,007 | 3/1963 | Campfield | 269/904 |
| 3,189,341 | 6/1965 | Maurus | 269/904 |
| 3,357,464 | 12/1967 | Vroman | 269/41 |
| 3,456,702 | 7/1969 | Johnson | 269/904 |
| 3,490,760 | 1/1970 | Nill . | |
| 3,663,004 | 5/1972 | Hupert | 269/904 |
| 3,718,327 | 2/1973 | Nunez . | |
| 3,899,163 | 8/1975 | Minagi . | |
| 3,982,739 | 9/1976 | Maes . | |
| 4,165,869 | 8/1979 | Williams | 269/41 |
| 4,453,705 | 6/1984 | McDonald . | |
| 4,629,171 | 12/1986 | Judy et al. . | |

*Primary Examiner*—Robert C. Watson

*Attorney, Agent, or Firm*—Litman, McMahon & Brown

[57] ABSTRACT

A cam locked stud nailing fixture includes a fixture base formed of a base web with depending side plates and a pair of spaced apart abutment flanges upstanding from the base web and having ends defining an abutment surface. A cylindrical cam is eccentrically mounted on one of the side plates and has a cam lever attached for pivoting the cam member. The other side plate has a plurality of gripping spikes projecting inwardly. The fixture is clamped onto a main framing member, such as a sole plate of a frame, by pivoting the cam into compressive engagement with the main framing member which causes the gripping spikes to extend into the main framing member to prevent slippage of the fixture along the main framing member. A branch framing member, such as a stud board, is positioned with its end against the main framing member and with a face engaging the abutment surface formed by the abutment flanges of the fixture. The fixture forms an anvil to stabilize the position of the stud during nailing.

18 Claims, 3 Drawing Sheets

Fig.1.
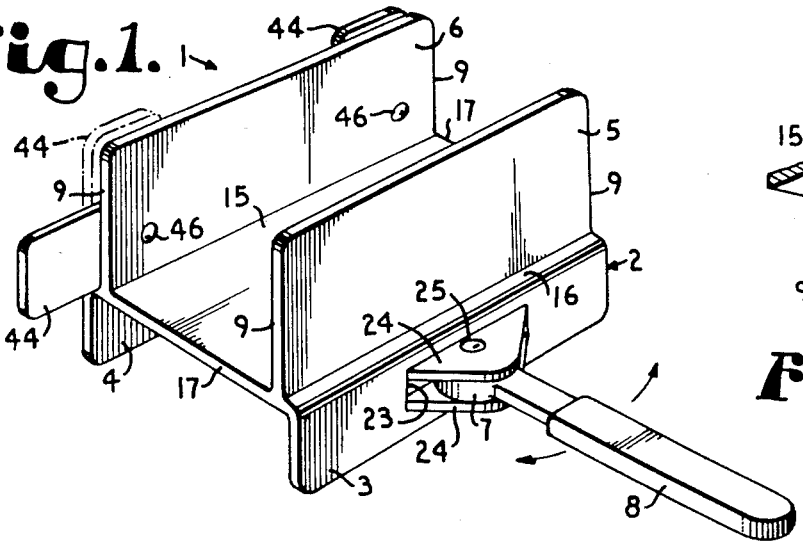
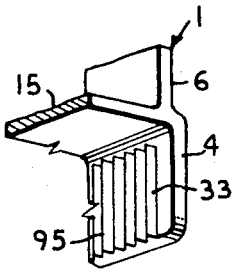
Fig.15.
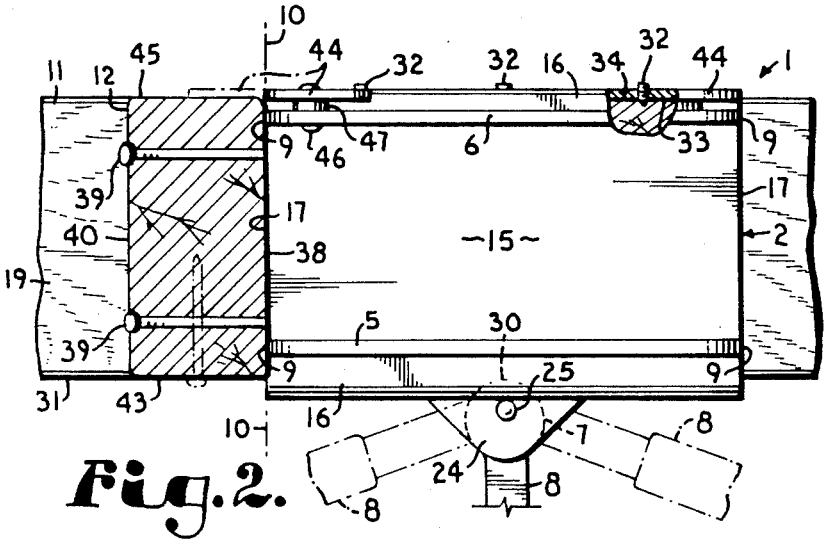
Fig.2.
Fig.3.
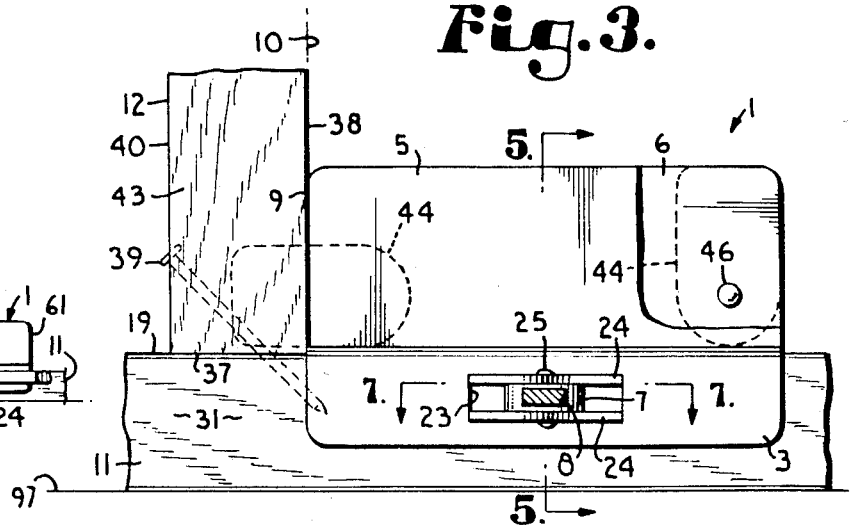
Fig.4.
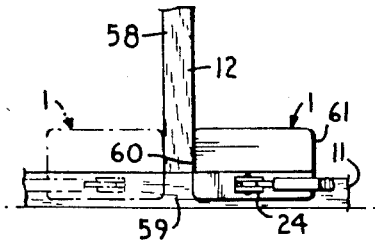

Fig.5.
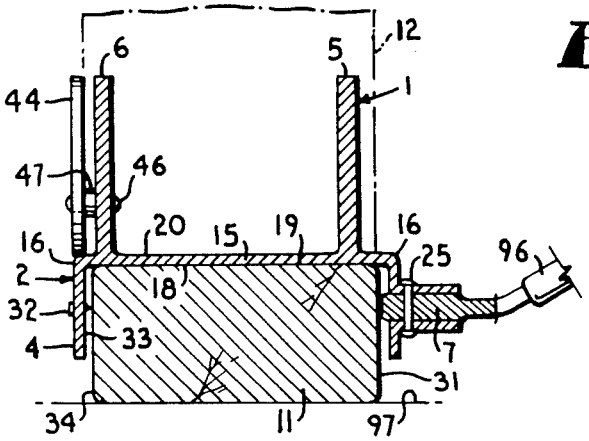
Fig.6.
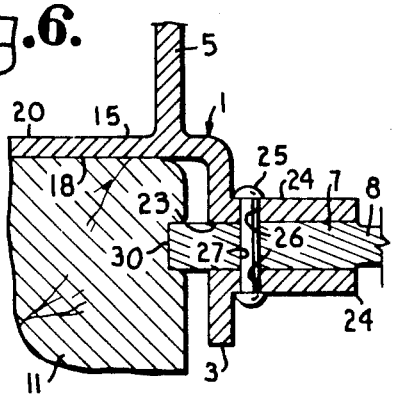
Fig.8.
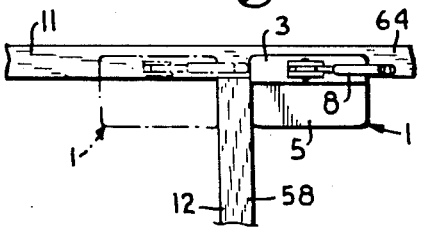
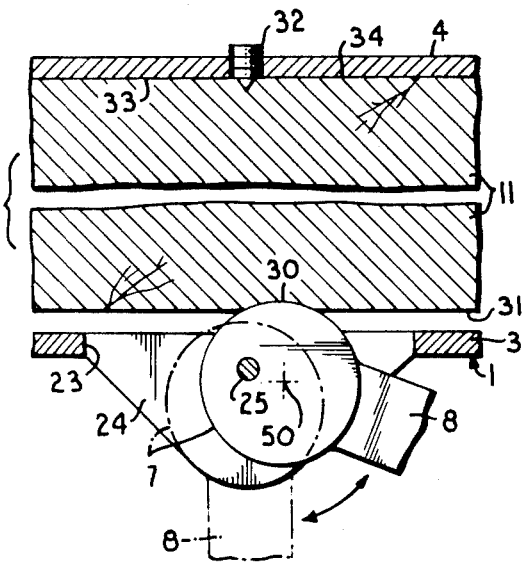
Fig.9.
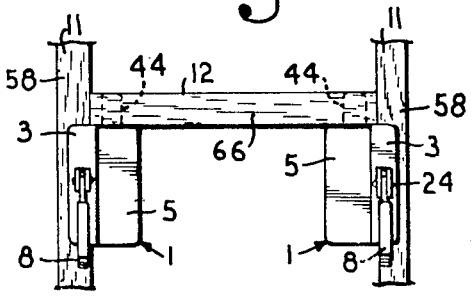
Fig.7.
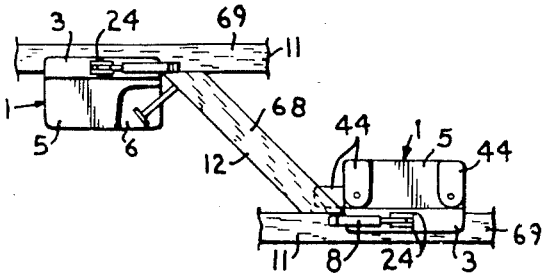
Fig.10.

Fig. 11.
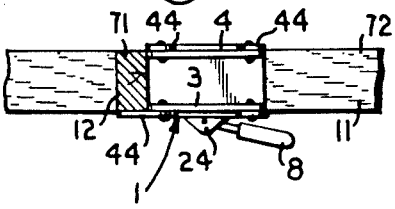
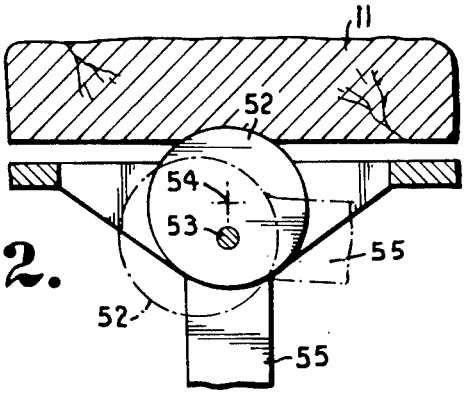
Fig. 12.
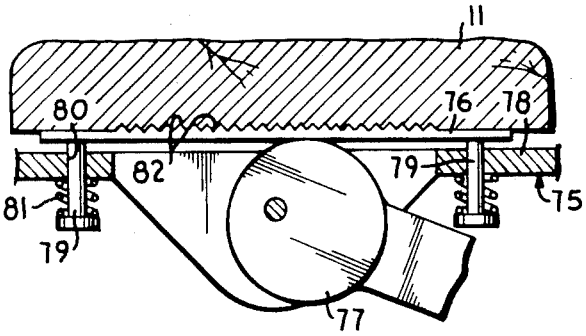
Fig. 13.
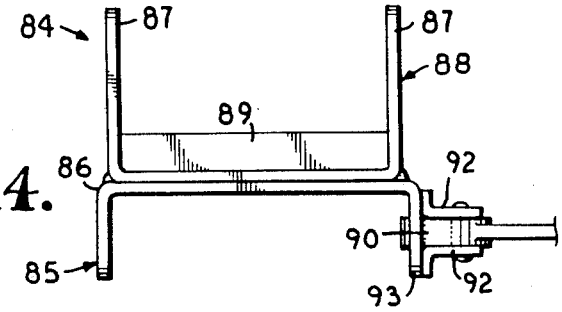
Fig. 14.

CAM LOCKED STUD NAILING FIXTURE

FIELD OF THE INVENTION

The present invention relates to assembly fixtures and, more particularly, to a cam locked fixture for stabilizing a board during nailing endwise to another board.

BACKGROUND OF THE INVENTION

During the assembly of wall frames in new construction, the frame members are generally joined while the frame is in a horizontal orientation; then the assembled frames are stood up, anchored, and connected to already standing frame sections. In such a method, it is a relatively simple matter to nail vertical studs to bottom and top plate members; the studs are positioned and nailed through the base and top members into the ends of the studs, since the surfaces of the bottom and top plate members being nailed through are easily accessible in the initial horizontal orientation of the frame section.

During remodeling construction, such as the construction of partition walls in existing rooms and the construction of dry wall support frames on concrete basement walls, the bottom and top plate members must be laid out and attached to existing floors and ceilings. The studs are then positioned and nailed. In such circumstances, the bottom surfaces of the bottom or sole plates and the top surfaces of the top plates are not accessible for nailing through to the ends of the studs. Consequently, the usual practice is to "toe-nail" the stud, that is, to drive nails at an angle through the stud into the bottom or top plate members.

A common problem which occurs during the toe-nailing of studs is that the hammer blows misposition the stud from plumb or vertical orientation. The simplest solution is to use brute force, that is, to hammer the stud into the proper position after nailing. When a stud is being toe-nailed to a sole plate, the problem can be overcome, to some extent, by the carpenter using his foot as an anchor on the opposite side of the stud from the hammered side. Such a solution is seldom practical, however, when toe-nailing the top of a stud to a top plate member. In the case of a stud which is non-standard in length and has been cut slightly short, the engagement of the top of the stud with the top plate is loose. Such a loose fit makes the maintenance of the correct position of a stud difficult even if the gap between the stud top and the top plate is shimmed.

Other than good building practices, a practical reason for the necessity of the studs being plumb, even in non-load-bearing walls, affects the later process of attaching dry wall panels, such as sheetrock, to the studs. In the installation of dry wall panels, the side edges of two adjacent panels normally overlap the side surface of a stud and are nailed thereto. If such a stud is out of plumb by even one degree of angle, the seam between the dry panels will completely be off the stud at one end, thus complicating the nailing of the panels to the stud.

The most precise solution to the problem of laterally shifting the end of a stud during nailing is to tack a block of wood across the face of the top or sole plate flush with the surface of the stud to act as an abutment or anvil during nailing. However, once one side of the stud has been nailed, the block must be removed so the opposite side can be nailed, thus adding to the labor involved.

SUMMARY OF THE INVENTION

The present invention provides an expedient solution to the problem of stud end shifting during nailing and to similar problems incurred in making T-connections of one board to another in various other spacial orientations. The present invention provides a quick release fixture which forms an abutment or anvil to react against the shifting of a stud under the impact of hammer blows during nailing. The fixture includes an inverted U-shaped fixture base to receive a sole or top plate member and a pair of abutment flanges projecting from a base web of the fixture base and having flange ends flush with the ends of the fixture base web which define abutment surfaces to engage a stud on either side of the fixture.

A cam actuated clamp arrangement removably affixes the fixture to the sole or top plate member. In its simplest form, a rotary cam mounted on one of a pair of side plates of the fixture base has a lever handle which is pivoted to compressively engage the sole or top plate. Such action urges board grippers on the side plate opposite the one having the cam mounted thereon into frictional engagement with a sole or top plate member within the fixture base. With the fixture positioned flush with the intended position of a stud and locked into place, the stud can then be positioned against the abutment formed by the abutment flanges and nailed. The other side of the stud can then be nailed through the space between the abutment flanges, or the cam can be released and the fixture removed.

The fixture preferably includes tabs rotatably mounted on at least one of the abutment flanges which can be pivoted out to engage one of the narrow sides of a stud to fix the position of the stud in the direction of the beam depth of the stud. The cam locked stud nailing fixture according to the present invention has utility not only in toe-nailing the ends of a vertical stud, but also in nailing horizontal cross members between standing studs, such as for fire breaks required under some building codes, for positioning angled members to form trusses, and even for positioning a horizontal beam to be nailed to an existing horizontal beam.

OBJECTS OF THE INVENTION

The principal objects of the present invention are: to provide a fixture to facilitate the toe-nailing of a vertical stud to sole and top plate members; to provide such a fixture which may be quickly and conveniently positioned and locked into place on a sole or top plate member to stabilize the position of the end of a stud during nailing and which can be quickly released and repositioned elsewhere; to provide such a fixture which is also applicable in the nailing of the end of a board to a middle portion of another board in a variety of orientations and range of angles; to provide such a fixture including a U-shaped fixture base formed by a base web with opposite side plates to fit on a sole or top plate of a frame, a cam operated clamp mounted on one of the side plates, and a pair of flanges extending between the ends of the fixture base plate in spaced apart and parallel relation and having flange ends defining abutment surfaces for engagement with the face of a stud or other board member being nailed; to provide such a fixture wherein the cam is circular in shape for simplicity and which is munted eccentrically such that rotation of the cam by a cam lever causes a surface of the cam to compressively engage the board received in the fixture base;

to provide such a fixture including deployable tabs on the abutment flanges to engage a narrow side of a stud to stabilize the position of the stud during nailing in the beam depth direction of the stud; to provide such a fixture including a gripping surface or projections on the side plate opposite the side plate having the cam mounted thereon to bite into or frictionally engage the board received in the fixture base; to provide an alternative embodiment of such a fixture which includes a toothed grip plate which is cammed into engagement with a board in the fixture base by operation of the cam lever; and to provide such a cam locked stud nailing fixture which is economical to manufacture, convenient and durable in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a cam locked stud nailing fixture according to the present invention.

FIG. 2 is a top plan view of the fixture shown positioned on a base member and engaged by a stud to fix the position thereof during nailing with right and left pivoted positions of a cam operating lever shown in phantom.

FIG. 3 is a side elevational view of the fixture positioned for nailing the lower end of a stud to a base member with alternate position of deployable end tabs mounted on abutment flanges shown in phantom.

FIG. 4 is a view similar to FIG. 3 at a reduced scale showing a first fixture according to the present invention on the right side of a stud with a second fixture shown in phantom on the left side of the stud.

FIG. 5 is a transverse sectional view taken on line 5—5 of FIG. 3 and illustrates a modified embodiment of a cam operating lever of a fixture which is angled to provide operating clearance.

FIG. 6 is an enlarged fragmentary view similar to FIG. 5 and illustrates a cam member of a fixture compressively engaging a base board member.

FIG. 7 is an enlarged fragmentary plan sectional view taken on line 7—7 of FIG. 3 and illustrates a locking position of the cam member with a released position of the cam member shown in phamtom.

FIG. 8 is a view similar to FIG. 4 and illustrates a first fixture according to the present invention on the right side of a stud with a second fixture shown in phantom on the left side of the stud.

FIG. 9 is a side elevational view at a reduced scale of a pair of fixtures according to the present invention locked on a pair of adjacent studs to support and fix the position of a horizontal cross member during the nailing of the cross member to the studs.

FIG. 10 is a view somewhat similar to FIG. 9 and illustrates a pair of the fixtures fixing the position of a board for nailing the ends of it in an angular orientation between a pair of horizontal boards.

FIG. 11 is an elevational view at a reduced scale of a fixture positioned on a first horizontally extending beam with an abutment tap deployed to fix the position of a second horizontally extending beam for nailing same to the first beam.

FIG. 12 is an enlarged plan sectional view of a fixture according to the present invention illustrating an alternative embodiment of a cam member which engages a board by pivoting a corresponding cam operating lever away from the fixture.

FIG. 13 is a view similar to FIG. 12 and illustrates another alternative embodiment of the fixture according to the present invention which includes a toothed grip plate cammed into engagement with a board by operation of the cam operating lever.

FIG. 14 is an end elevational view of a fixture according to the present invention at a somwhat reduced scale and illustrates alternative construction details of the fixture.

FIG. 15 is an enlarged fragmentary perspective view illustrating an alternative gripping surface for gripping a board received in the fixture base of a fixture according to the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a cam locked stud nailing fixture according to the present invention. The fixture 1 generally includes a fixture base 2 including a pair of depending side plates 3 and 4 and a pair of upstanding abutment flanges 5 and 6. A cam member 7 is pivotally mounted on one of the side plates, such as plate 3, and has a cam lever 8 attached thereto for pivoting the cam 7. The flanges 5 and 6 have ends 9 which define an abutment surface 10 (FIG. 2). The fixture base 2 is clamped onto a main framing member 11 by operation of the cam member 7 to fix the position of a branch framing member 12 and form an anvil therefor during the nailing of the branch member 12 to the main member 11. The fixture 1 is removed from the main member 11 after the branch member 12 is nailed thereto by releasing the clamping cam 7.

As illustrated in FIGS. 1–7, the term "main framing member" 11 refers to a bottom or sole plate of a vertical wall frame while the term "branch framing member" 12 refers to a stud of the frame. As will be detailed below, the fixture 1 is capable of use in many other orientations of framing members to be joined. Generally, the fixture 1 is used to facilitate the joining the end of a branch framing member 12 in a T-connection to a main framing member 11. However, the use of the fixture 1 is not restricted to perpendicular framing member joints but is also useful for connections of other angles. Further, the framing members 11 and 12 are principally boards having a two by four "inch" cross section. However, the fixture 1 may be sized to accommodate any standard size timbers or lumber.

Referring to FIGS. 1, 2, and 5, the fixture base 2 includes a base web 15 having opposite side edges 16 and opposite end edges 17. The side plates 3 and 4 depend from the side edges 16 of the base web 15 perpendicular to a lower surface 18 (FIG. 5) of the base web 15. The side plates 3 and 4 are spaced apart a distance somewhat greater than the width of the face 19 of the main framing members 11 with which the fixture 1 is to be used. The clearance provided by this spacing facilitates the placement of the fixture 1 on a main framing member 11. The abutment flanges 5 and 6 project upwardly from an upper surface 20 (FIG. 5) of the base web 15 and are spaced inward from the side edges 16 of the web 15. The ends 9 of the flanges 5 and 6 are flush with the end edges 17 of the base web 15.

The cam member 7 is pivotally mounted on one of the side plates of the fixture base 2, such as the side plate 3. A slot 23 is formed at a centered position through the side plate 3. A pair of ears 24 project outward from the side plate 3 and have aligned apertures 26 (FIG. 6) formed therethrough. A pivot pin, such as the illustrated rivet 25, passes through the apertures 26 in the ears 24 and a pivot bore 27 formed through the cam member 7. Alternatively, other configurations of pivot pins 25 could be employed, such as a press fit pin (not shown) or a bolt and nut combination (not shown).

The cam member 7 has a cam surface 30 which is advanced through the slot 23 when the cam member 7 is pivoted from a non-locked position to a locked position. Such pivoting engages the cam surface 30 with a side surface 31 of a main framing member 11 on which the fixture 1 is positioned. The fixture 1 is provided with means to positively grip the main framing member 11. As illustrated in FIGS. 2, 5, and 7, the gripping means comprises a plurality of gripping spikes 32 threaded into the side plate 4 and projecting inward of an inner surface 33 of the side plate 4. As the cam member 7 is pivoted toward its locked or clamped position, the compressive engagement of the cam surface 30 with the side surface 31 of the main framing member 11 causes the fixture 1 to shift across the member 11 whereby the spikes 32 penetrate the opposite side surface 34 of the main member 11 until the inner surface 33 of the side plate 4 engages the side surface 34 of the main member 11. By these actions, the fixture 1 is securely clamped onto the main framing member 11.

Once the fixture 1 is clamped onto a main framing member 11, a branch framing member 12 can be positioned with an end 37 engaging a face 19 of the main framing member 11 and with a face 38 of the branch framing member 12 engaged with the abutment surface 10 defined by the ends 9 of the abutment flanges 5 and 6. Thus positioned, nails 39 are hammered at a downward angle through an opposite face 40 of the branch framing member 12 and into the main framing member 11. During hammering of the nails 39, the fixture 1 acts as an anvil or abutment to prevent the branch framing member 12 from shifting along the main framing member 11 in response to the hammer blows. The branch framing member 12 may be similarly toe-nailed from the other side through the face 38 by driving additional nails 39 into the member 12 through the space between the flanges 5 and 6; or, alternatively, the fixture 1 may be unclamped and removed.

At times, it is desirable to toe-nail a branch framing member 12 through a side surface 43 (FIG. 2) thereof. In order to stabilize the branch member 12 during such a procedure, the fixture 1 is provided with side nailing tabs 44 which may be deployed to engage an opposite side 45 of the branch framing member 12. The tabs 44 are pivotally mounted on the abutment flange 6 by means such as rivets 46. Spacers 47 may be positioned between the tabs 44 and the flange 6 to position the tabs 44 for engagement with the side 45 of the branch framing member 12. The tabs 44 are pivoted out about the rivets 46 when needed and retracted when their use is not required. For some joining operations, it might be desirable to provide the abutment flange 5 with tabs 44.

Referring to FIG. 7, the preferred cam member 7 is cylindrical in shape and has a cylindrical axis, represented at 50. As illustrated, the cam pivot 25 is positioned on an opposite side of the cylindrical axis 50 from the cam lever 8 and in line therewith. With the axis 50 and pivot 25 so related, the cam 7 engages the main framing member 11 by revolving the cam lever 8 from a position substantially perpendicular to the side plate 3 toward the side plate 3. The cam lever 8 is, thus, pushed toward the fixture 1 to engage the cam member 7 with the main framing member 11. Since the illustrated cam member 7 is symmetrical about a line defined by the pivot 25 and the axis 50, the cam lever 8 may be pivoted in either a clockwise direction or a counterclockwise direction, as is depicted by the alternative phantom representations of the cam lever 8 in FIG. 2.

FIG. 12 illustrates an alternative cam member 52 having a cam pivot 53 positioned between a cylindrical axis 54 and a cam lever 55. With the pivot 53 and axis 54 so related, the cam 52 is disengaged from the main framing member 11 when the lever 55 is substantially parallel with the member 11 and engages the member 11 upon pivoting or pulling the lever 55 away from the member 11. The cam member 52 is symmetrical about a line defined by the pivot 53 and axis 54 and can, thus, be operated by clockwise or counterclockwise pivoting. However, the starting position must be selected before a fixture employing the cam member 52 is placed on a main framing member 11.

FIGS. 4 and 8–11 illustrate the fixture 1 employed in a variety of orientations to facilitate the joining of branch framing members 12 to main framing members 11. FIG. 4 shows the use of a fixture 1 to stabilize the position of a stud 58 to a sole plate 59. The symmetry of the fixture 1 is illustrated by a second fixture 1 shown in phantom in FIG. 4. Thus, the fixture 1 can be positioned for engagement by a stud 58 from a left end 60 of the fixture 1 or from a right end 61 of the fixture. FIG. 8 illustrates the use of fixtures 1 to stabilize a top end of a stud 58 being joined to a top plate 64 of a frame. As in FIG. 4, the symmetry of the fixture 1 contributes to its versatility of use.

FIG. 9 illustrates fixtures 1 stabilizing a cross member 66 being joined between a pair of adjacent studs 58, for example, to form a fire break in a frame or to frame around windows. As illustrated, tabs 44 of the fixtures 1 are deployed to stabilize the sides of the cross member 66. FIG. 10 shows the use of fixtures 1 to stabilize the position of a diagonal member 68 being joined between a pair of adjacent and parallel timbers 69, for example, to form a truss. The lower fixture 1 in FIG. 10 is shown with tabs 44 provided on the abutment flange 3. Finally, FIG. 11 illustrates a fixture 1 stabilizing a frame member 71 for attachment to a horizontal beam 72. The fixture 1 in FIG. 11 is shown with tabs 44 provided on both abutment flanges 3 and 4.

FIG. 13 illustrates a modified embodiment of the fixture according to the present invention. The fixture 75 employs a grip plate 76 which is cammed into engagement with a main framing member 11 by pivoting a cam member 77. The grip plate 76 is mounted for reciprocating movement relative to a side plate 78 by rods 79 extending through apertures 80 in the side plate 78. The plate 76 is urged toward the side plate 78 by compression springs 81 received on the rods 79. The grip plate 76 is provided with ridges or teeth 82 which positively grip the main framing member 11 when the grip plate 76 is extended by pivoting the cam member 77. Upon pivoting the cam 77 to a release position, the springs 81 cause the grip plate 77 to retract from the main framing member 11.

FIG. 14 illustrates a fixture 84 according to the present invention which is formed by the assembly of standard types of metal stock. A fixture base 85 is formed by a down turned channel section 86. The channel section 86 has a width to receive a main framing member 11 therein, with a small clearance. Abutment flanges 87 are formed by an up turned channel section 88 attached to the channel section 86, as by welding. The channel section 88 is somewhat narrower than the channel section 86. Ribs 89 connect between the flanges 87 to stiffen same. A cam member 90 is pivotally connected to a pair of L-brackets 92 attached, as by welding, to one of the flanges 93 of the fixture base channel section 86. Use and operation of the fixture 84 is substantially similar to the fixture 1.

FIG. 15 illustrates an alternative gripping means to the gripping spikes 32 shown in FIGS. 1, 2, and 5. Gripping ridges or teeth 95 are formed on the inner surface 33 of the side plate 4 and are drawn into biting engagement with a main framing member 11 when a fixture 1 employing the teeth 95 is clamped thereon.

In FIG. 5, an alternative cam lever 96 is shown which is angled with respect to the base web 15. The angled configuration of the cam lever 96 provides increased clearance between it and a floor surface 97 supporting the main framing member 11.

It is to be understood that while certain forms of the present invention have been illustrated and described herein, it is not to be limited to the specific forms or arrangement of parts described and shown.

What is claimed and desired to be secured by Letter Patent is as follows:

1. A removable framing member fixture for facilitating the fastening of a branch framing member to a main framing member, said fixture comprising:

(a) a fixture base having opposite ends;

(b) clamp means connected to said fixture base and operable to removably attach said fixture base to a main framing member; and (c) an abutment positioned on said fixture base for engagement by a branch framing member during the fastening of said branch member to said main member, said abutment including:

(1) a pair of abutment flanges projecting from said fixture base and having opposite flange ends;

(2) said abutment flanges extending along said fixtures base such that said flange ends are substantially flush respectively with said opposite ends of said fixture base and define an abutment surface engageable by said branch framing member.

2. A fixture as set forth in claim 1 wherein said clamp means includes:

(a) a cam member rotatably mounted on said fixture base and rotatable to compressively engage said main member to removably attach said fixture base to said main framing member.

3. A fixture as set forth in claim 2 including:

(a) a clamp lever attached to said cam member to rotate said cam member.

4. A fixture as set forth in claim 3 wherein:

(a) said cam member is substantially cylindrical and has a cylindrical axis;

(b) said cam member has an axis of rotation; and (c) said axis of rotation is spaced from said cylindrical axis in such a manner that said cam member is rotated to a clamp position to compressively engage said main framing member by revolving said clamp lever in a direction angularly toward said fixture base.

5. A fixture as set forth in claim 4 wherein:

(a) said axis of rotation of said cam member is positioned with respect to said cylindrical axis such that said cam member is rotated to a clamp position to compressively engage said main framing member by revolving said clamp lever in a first angular direction toward said fixture base and in an opposite second angular direction toward said fixture base.

6. A fixture as set forth in claim 1 including:

(a) a cam member having a cam surface, rotatably mounted on said fixture base, and rotatable to urge said cam surface toward a main framing member received by said fixture base; and (b) a grip plate mounted on said fixture base and engaged by said cam surface in such a manner that rotation of said cam member urges said grip plate into compressive engagement with said main framing member to thereby removably clamp said main framing member.

7. A fixture as set forth in claim 1 wherein said fixture base includes:

(a) a base web having opposite sides, opposite ends, and opposite surfaces;

(b) a pair of side plates projecting from one of said surfaces along said opposite sides of said base web in spaced apart and parallel relation to form a U-shaped member to receive said main framing member therein; and (c) said clamp means is connected to a first side plate of said pair of side plates.

8. A fixture as set forth in claim 7 wherein:

(a) said clamp means urges said first side plate of said fixture base away from said main framing member upon the operation of said clamp means; and (b) framing member grip means is positioned on a second side plate of said pair of side plates such that, upon operation of said clamp means, said grip means engages said main framing member to thereby resist movement of said fixture in a direction parallel to said side plates during the fastening of said branch framing member to said main framing member.

9. A fixture as set forth in claim 1 wherein said branch framing member includes a pair of opposite branch framing member faces and a pair of opposite branch framing member sides, one face of said branch framing member being engaged by said abutment of said fixture, and at least one of said abutment flanges includes:

(a) an abutment tab connected to one of said abutment flanges and deployable to engage a side of said branch framing member when said branch framing member engages said abutment surface defined by said abutment flanges.

10. A fixture as set forth in claim 1 wherein said fixture has opposite right and left ends, and wherein:

(a) said fixture is symmetrically shaped for abutment by a branch framing member at either the right end or the left end of said fixture.

11. A removable framing member fixture for facilitating the fastening of a branch framing member to a main framing member, said fixture comprising:

(a) a base web having opposite sides, opposite ends, and opposite surfaces;

(b) a pair of side plates projecting from one of said surfaces of said base web along said opposite sides of said base web in spaced apart and parallel relation to form a U-shaped member to receive a main framing member therein, said base web and said pair of side plates forming a fixture base;

(c) a cam member rotatably connected to a first side plate of said pair of side plates and rotatable to compressively engage said main member to removably attach said fixture base to said main framing member;

(d) a pair of abutment flanges projecting from said base web and having opposite flange ends; and (e) said abutment flanges extending along said base web such that said flange ends are substantially flush respectively with said opposite ends of said base web and define an abutment surface engageable by a branch framing member during the fastening of said branch framing member to said main framing member.

12. A fixture as set forth in claim 11 including:

(a) a cam lever attached to said cam member to rotate said cam member.

13. A fixture as set forth in claim 11 wherein:

(a) said cam member, upon rotation, urges said first side plate away from said main framing member; and (b) framing member grip means is positioned on a second side plate of said pair of side plates such that, upon rotation of said cam member, said grip means engages said main framing member to thereby resist movement of said fixture in a direction parallel to said side plates during the fastening of said branch framing member to said main framing member.

14. A fixture as set forth in claim 11 wherein said branch framing member includes a pair of opposite branch framing member faces and a pair of opposite branch framing member sides, one face of said branch framing member being engaged by said abutment of said fixture, and at least one of said abutment flanges includes:

(a) an abutment tab connected to one of said abutment flanges and deployable to engage a side of said branch framing member when said branch framing member engages said abutment flanges.

15. A fixture as set forth in claim 11 wherein:

(a) a cam lever is attached to said cam member to rotate same;

(b) said cam member is substantially cylindrical and has a cylindrical axis;

(c) said cam member has an axis of rotation; and (d) said axis of rotation of said cam member is spaced from said cylindrical axis in such a manner that said cam member is rotated to a clamp position to compressively engage said main framing member by said cam lever.

16. A fixture as set forth in claim 11 including:

(a) said cam member having a cam surface and being rotatable to urge said cam surface toward a main framing member received by said fixture base; and (b) a grip plate mounted on said fixture base and engaged by said cam surface in such a manner that rotation of said cam member urges said grip plate into compressive engagement with said main framing member to thereby removably clamp said main framing member.

17. A removable stud nailing fixture for facilitating the nailing of a stud boar substantially to a main board, said fixture comprising:

(a) a base web having opposite sides, opposite ends, and opposite surfaces;

(b) a pair of side plates projecting from one of said surfaces of said base web along said opposite sides of said base web in spaced apart and parallel relation to form a U-shaped member to receive a main board therein, said base web and said pair of side plates forming a fixture base;

(c) a cam member rotatably connected to a first side plate of said pair of side plates and rotatable to compressively engage said main board to removably attach said fixture base to said main board, a cam lever being attached to said cam member to rotate said cam member;

(d) a pair of abutment flanges projecting from said base web and having opposite flange ends;

(e) said abutment flanges extending along said base web such that said flange ends are substantially flush respectively with said opposite ends of said base web and define an abutment surface engageable by a stud board during the fastening of said stud board to said main board; and (f) main board grip means positioned on a second side plate of said pair of side plates such that, upon rotation of said cam member, said first side plate is urged away from said main' board causing said grip means to engage said main board to thereby resist movement of said fixture in a direction parallel to said side plates during the fastening of said stud board to said main board.

18. A fixture as set forth in claim 17 wherein said stud board includes a pair of opposite stud board faces and a pair of opposite stud board sides, one face of said stud board being engaged by said abutment flanges, and at least one of said abutment flanges includes:

(a) an abutment tab connected to one of said abutment flanges and deployable to engage a side of said stud board when said stud board engages said abutment flanges.

* * * * *